United States Patent [19]

Napolitano et al.

[11] Patent Number: 4,553,405

[45] Date of Patent: Nov. 19, 1985

[54] VENT ASSEMBLY FOR USE WITH AN AIR CONDITIONING UNIT

[75] Inventors: James E. Napolitano; Theodore S. Bolton, both of Liverpool; John P. McHale, Syracuse, all of N.Y.

[73] Assignee: Carrier Corporation, Syracuse, N.Y.

[21] Appl. No.: 559,677

[22] Filed: Dec. 9, 1983

[51] Int. Cl.[4] ..... F25D 23/12

[52] U.S. Cl. ..... 62/262; 62/263; 62/410

[58] Field of Search ..... 62/410, 262, 263

[56] References Cited

U.S. PATENT DOCUMENTS

| | | | |
|---|---|---|---|
| 2,260,503 | 10/1941 | Zeidler | 62/410 |
| 3,301,166 | 1/1967 | Schwartz | 62/262 |
| 3,305,162 | 2/1967 | Hall, Jr. | 62/262 |
| 3,762,182 | 10/1973 | Loos et al. | 62/262 |
| 3,783,637 | 1/1974 | Woods | 62/263 |
| 3,792,593 | 2/1974 | Loos et al. | 62/262 |
| 3,823,574 | 7/1974 | Bolton | 62/262 |
| 3,826,105 | 7/1974 | Marsteller | 62/262 |
| 3,938,348 | 2/1976 | Rickert | 62/262 |
| 4,129,996 | 12/1978 | Hardin et al. | 62/262 |

*Primary Examiner*—Ronald C. Capossela
*Attorney, Agent, or Firm*—Dana F. Bigelow

[57] ABSTRACT

A vent assembly for use in an air conditioning unit is disclosed. The vent assembly extends from the condenser fan shroud to the partition for directing air at a relatively higher condenser fan pressure through the vent assembly to the indoor section wherein the evaporator fan circulates the air to the indoor section to be conditioned. The vent assembly is an integral self-contained portion capable of being easily inserted within an existing unit for effecting desired airflow control.

11 Claims, 4 Drawing Figures

VENT ASSEMBLY FOR USE WITH AN AIR CONDITIONING UNIT

BACKGROUND OF THE INVENTION

This invention relates to air conditioning units which are adapted to provide outside air to a space to be conditioned. More specifically, the present invention relates to a vent apparatus for providing means for directing outside air into the interior portion of an air conditioning unit for distribution to the space to be conditioned.

Air conditioning units which are commonly used for residential and similar applications generally are contained within a single casing. This casing is usually divided by a partition into an evaporator section and a condenser section, each having its own fan to circulate air therethrough. An air conditioning unit is normally mounted with the evaporator section communicating with the room air to be conditioned and the condenser section communicating with external air such as outside air. Refrigerant flows through the self-contained refrigerant circuit removing heat energy from the room air and discharging heat energy to the outside air.

In addition to the capability of the air conditioning unit to provide temperature controlled air to the room, it is desirable for the unit to have means for providing vent air (outdoor ambient air) to the room. This is accomplished by the provision of a duct assembly including a door for controlling airflow therethrough between the outdoor section and indoor section of the unit. Part of the air is supplied from a high pressure region defined by a condenser fan scroll cooperating with a condenser fan. The air is ducted therefrom to the interior section of the unit wherein the indoor fan acts to draw said air through the duct and to discharge same to the room. In this manner, vent air may be supplied to the room to be conditioned.

The purpose of providing ventilation air is to allow air to be circulated to the space when it is not necessary to effect heating or cooling of the air. Additionally, it may be desirable to provide fresh outside air in combination with the air being heated or cooled, depending upon whether or not the unit is a heat pump or a straight cooling unit, such that vent air may be combined with the recirculated air to effect a different mix of air within the room.

It is also more energy efficient under appropriate outdoor ambient conditions to circulate outdoor air to the interior space as opposed to operating the refrigeration circuit. Should cooling be desired within the space to be conditioned and the outdoor air temperature is lower than that space temperature then the mere substitution of outdoor air for indoor air may effect the desired temperature change.

The herein described vent assembly provides for a two piece vent duct having upper and lower halves with a self-contained door. A screen is provided which snaps into place and is removable. No door frame or seal is required and the duct is arranged such that the high pressure region generated by the condenser fan acts to maintain the door in the closed position. Additionally, the entire assembly slides into place between the partition and the condenser fan orifice of the unit and is both self-locating and held in place with a single screw.

SUMMARY OF THE INVENTION

It is an object of the present invention to provide an air conditioning unit with a vent assembly for allowing outdoor ambient air to enter the indoor section of the unit.

A more specific object of the present invention is to provide a combination duct and door assembly extending between the condenser fan orifice and a partition whereby air from the high pressure region created by the condenser fan may flow through the vent to the indoor section.

It is a further object of the present invention to provide a vent duct which acts cooperatively with both a condenser fan and an indoor fan for effectively moving air from the exterior of the unit to the interior to help condition the space.

Another object of the present invention is to provide an apparatus to selectively open and close a door contained in a vent assembly.

A still further object of the present invention is to provide apparatus which is economical to manufacture and maintain, simple in construction, easy to operate and compact in size and number of parts.

Other objects will be apparent from the description to follow and from the appended claims.

The preceding objects are achieved according to the preferred embodiment of the invention by the provision of an air conditioning unit which is divided by a partition into an indoor section and an outdoor section. The indoor section includes an indoor heat exchanger and means for circulating air between the space to be conditioned and the indoor section. The outdoor section includes an outdoor heat exchanger and means for circulating outdoor air through the outdoor section. An outdoor circulating means shroud includes surfaces for directing outdoor air within the outdoor section and further defining an opening therethrough, a partition defining an opening and a vent assembly including surfaces defining an air passageway. The vent assembly extends from the opening in the outdoor circulating means shroud to the opening in the partition such that air may flow between the outdoor section and the indoor section and said vent assembly further including door means for controlling the flow of air therethrough.

A vent assembly for use in an air conditioning unit is additionally disclosed. The assembly includes a bottom portion having a bottom wall and side walls extending upwardly from the bottom portion, said bottom wall including an embossment defining an opening, a door assembly including a crankshaft having a downwardly extending pin which may be secured in the opening defined by the embossment for mounting the crankshaft thereto, a door connected to the crankshaft and a crank extending from the crankshaft for effecting rotational displacement of the crankshaft. The assembly further includes a top portion having a top wall and two downwardly extending side walls, said side walls mating with the side walls of the bottom portion such that the top and bottom portions together define an air flow passageway, said top portion defining an opening through which the crankshaft extends and the door of the door assembly being located between the top and bottom portions to control the flow of air through the passageway.

DESCRIPTION OF THE PREFERRED EMBODIMENT

The apparatus as described herein will refer to a vent assembly for use in a packaged terminal type air conditioning unit. It is to be understood that this vent assembly has applicability to other types of air conditioning units and may extend between the appropriate components to perform the same function as herein. It is further to be understood that although the invention herein will be described in relation to an air conditioning unit that the term air conditioning unit is meant to include units capable of reverse cycle heating, heating with electric resistance heat as well as units which effect cooling only of the space to be conditioned.

Figure 2:
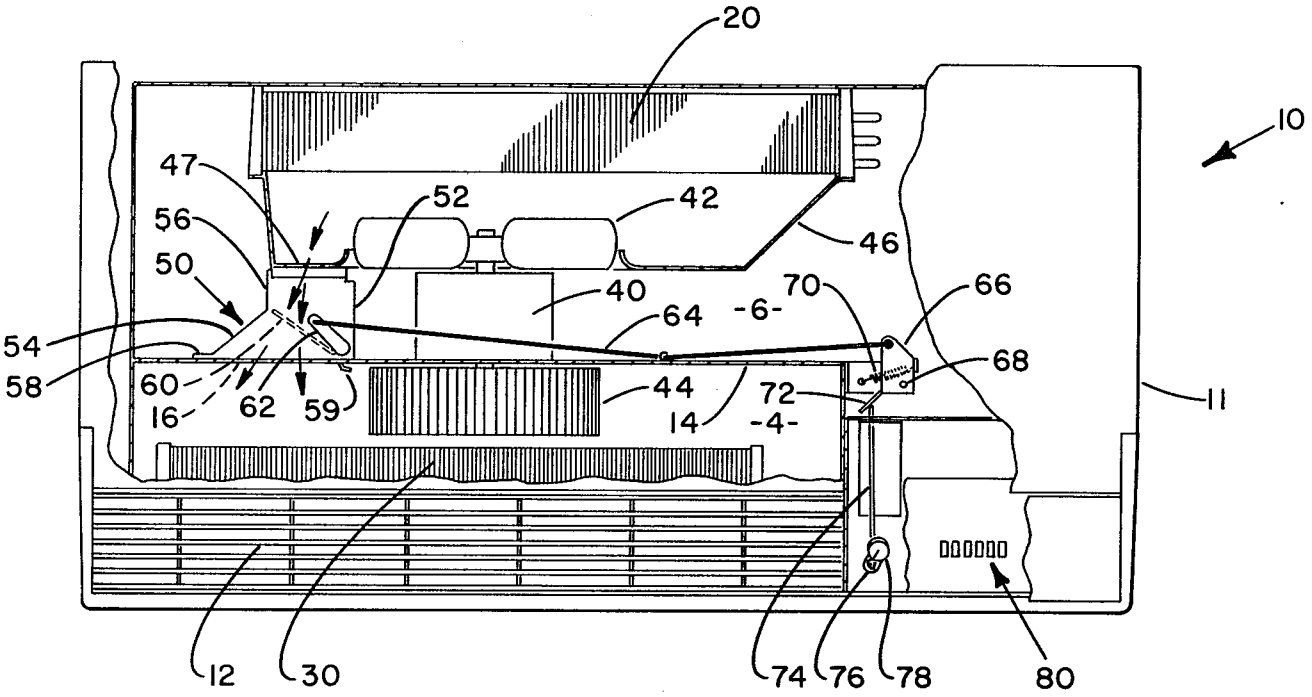
FIG. 2 is a partially cutaway top view of a packaged terminal air conditioning unit including the vent assembly.

Referring first to FIG. 2, there may be seen a top partially cutaway view of a packaged terminal air conditioning unit 10. This unit is divided by partition 14 into an outdoor section 6 and indoor section 4. Evaporator fan 44 acts to draw air from the room to be conditioned into the unit through openings not shown, through evaporator 30 wherein the air is reduced in temperature and said air then being directed out of the unit through discharge grille 12 back to the space to be conditioned.

Within outdoor section 6 may be seen fan motor 40, condenser 20, condenser fan 42 and condenser fan shroud 46. The fan motor 40 acts to drive both evaporator fan 44 and condenser fan 42. Condenser fan 42 acts to draw outdoor ambient air into the unit and directs said air through condenser 20. Condenser fan shroud 46 acts to divide the outdoor section to define an airflow stream such that the air is brought around the condenser fan shroud 46 to a position between the partition and the condenser fan shroud. The fan then acts to draw this air through an opening where the condenser fan is located and to direct the air outwardly over condenser 20 and then further outwardly through an opening in the unit, not shown. The condenser fan 42 acts to create a high pressure region and a low pressure region within the outdoor section. The low pressure region is that region wherein the air is drawn from prior to passing through the opening in the condenser fan shroud. Condenser fan 42 acts to maintain a higher pressure region between the condenser fan, condenser and condenser fan shroud since there is a pressure drop created by the air flowing through the condenser.

In the bottom right hand portion of the unit is shown controls area 80. Controls area 80 includes a series of knobs for effecting control of the unit. A vent control knob 78 is shown having a bell connection 76. From bell connection 76 push rod 74 extends to engage cam surface 72 of motion translator 66. Motion translator 66 is designed to rotate about pivot point 68. Spring 70 acts to bias motion translator 66 in a particular direction. When knob 78 is turned, bell connection 76 acts to move push rod 74 towards the condenser causing the motion translator 66 to rotate clockwise. Actuator 64 extends from motion translator 66 to the door crank 62 controlling door 60 in the vent assembly 50. Rotation of the motion translator 66 acts to cause the door 60 to rotate thereby controlling the flow of air through the vent assembly 50. Additional components of the air conditioning unit such as the compressor, four-way valve, accumulator and other components which are not shown are typically located in the outdoor section of the unit.

Vent assembly 50 is shown extending from condenser fan shroud 46 to partition 14. Vent assembly 50 includes side wall 52, return wall 56 and angle wall 54 defining the sides thereof. Additionally provided but not seen in this view are top and bottom walls. Flange 58 is provided for abutting against partition 54. Projection 59 extends from the vent assembly through an opening in the partition to position the vent assembly. Door 60 is shown in the center of the vent assembly for controlling airflow therethrough. Door 60 is mounted to a crankshaft which also has door crank 62 mounted thereto. Opening 47 is provided in the condenser fan orifice for allowing air to flow from the outdoor section high pressure area defined within the condenser fan shroud through the vent duct which extends through the low pressure area of the outdoor section and then into the indoor section through opening 16 in partition 14.

Figure 1:
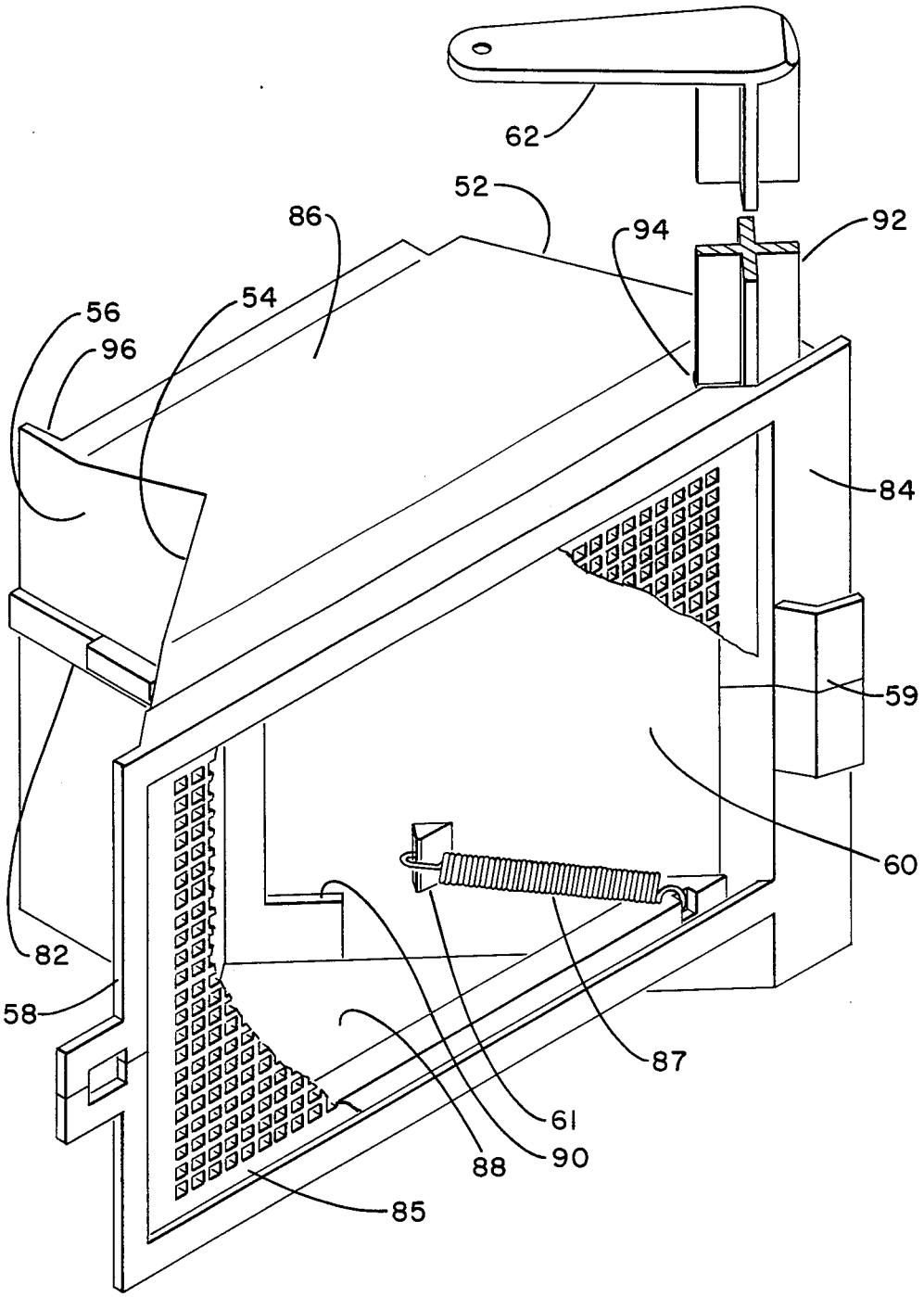
FIG. 1 is a isometric view of the vent assembly including the door.

Referring now to FIG. 1, there may be seen an isometric view of the vent assembly. Herein it may be more particularly seen that the vent assembly includes return wall 56, angle wall 54, bottom 88, top 86 and side wall 52 all defining a passageway for air. The vent assembly includes return wall extension 96 which may be seen cooperating with the condenser fan shroud 46 in FIG. 2 for positioning the vent assembly.

Additionally, towards the front of the vent duct assembly there may be seen partition abutment face 84. This face is designed to abut against partition 14 to additionally help align the vent assembly. Projection 59 extends outwardly from partition abutment face 84 and is designed to fit through the opening defined by the partition to secure the vent duct in position. An opening is shown at the left hand side of the assembly in an extension from flange 58. This opening is designed to allow a screw to be inserted therethrough for locking the vent assembly in position.

Door 60 is shown mounted for rotational displacement to crankshaft 92. Door stop 90 is formed in the lower and upper portions of the vent assembly and coacts with the door to provide a stop surface. Additionally, door stop 90 serves as a seal when the door is in the closed position to help prevent flow through the vent assembly. Spring 87 extends between door spring connector 61 mounted to the door and the frame of the vent assembly such that the spring biases the door to the closed position. Crank 62 is shown extending from crankshaft 92 having an opening therein for engagement with the actuator 64. Overlap 82 is shown about the entire vent assembly to show that the assembly is made of two pieces. The bottom piece includes a bottom wall and portions of the side walls and the top piece includes the top wall and portions of the side walls. The two pieces meet and one has an overlap portion extending over the other such that the side walls coact to form the assembly as shown.

Figure 3:
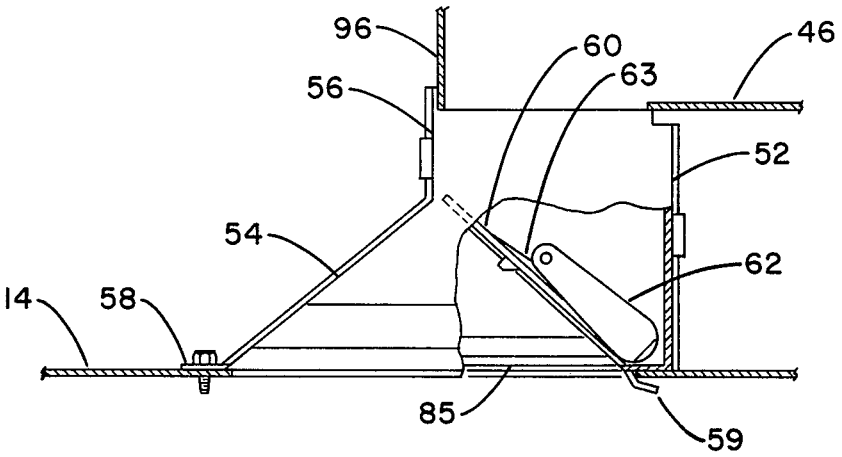
FIG. 3 is an enlarged top view of the vent assembly.
Figure 4:
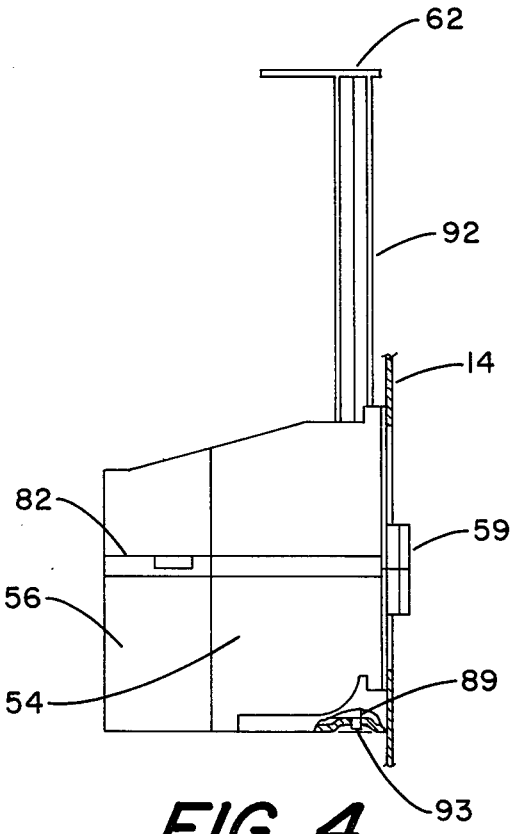
FIG. 4 is a side view of the vent assembly.

Referring more specifically to FIGS. 3 and 4, additional details of the vent assembly may be seen. In FIG. 3 it may be seen that door support 63 extends from the crankshaft to provide structural support to door 60. Additionally, it can be seen the relationship between partition 14 and projection 59 and the manner in which they coact to maintain the vent assembly in position. Screen 85 is shown in FIG. 1 and may additionally be seen in FIG. 3. The screen is mounted to prevent unwanted objects from flowing through the vent assembly.

From FIG. 4 it can be seen that crankshaft 92 has a pin 93 extending from the bottom thereof. Additionally, embossment 89 is shown extending upwardly from the bottom portion of the vent assembly such that the pin 93 extends through an opening in the embossment for securing the crankshaft for rotational movement. The crankshaft additionally extends through an opening 94, as can be seen in FIG. 1, through top 86. Between the pin and the embossment at the bottom and the opening 94 at the top, the crankshaft with the attached door assembly, is securely held for rotational displacement. Overlap 82 may be clearly seen in FIG. 4 as can the relationship between the crankshaft and the bottom of the unit.

The invention herein has been described with reference to a particular embodiment. It is to be understood by those skilled in the art that variations and modifications can be effected within the spirit and scope of the invention.

What is claimed is:

1. An air conditioning unit which is divided by a partition into an indoor section and an outdoor section, said indoor section having an indoor heat exchanger and fan means for circulating air between the space to be conditioned and the indoor section, and said outdoor section having an outdoor heat exchanger and fan means for circulating outdoor air through the outdoor section which comprises:

an outdoor circulating fan means shroud including surfaces for directing outdoor air within the outdoor section and further defining an opening therethrough;

said partition defining an opening;

a vent assembly including surfaces defining an air passageway extending from the opening in the outdoor circulating means shroud to the opening in the partition such that air may flow from the outdoor section to the indoor section, and said vent assembly further including door means positioned in the passageway for controlling the flow of air therethrough; and said door means including a door frame located in said passageway between said door and said partition, such that when said door is in the closed position the air pressure in the outdoor section tends to force said door against said door frame to thereby provide a sealing effect therebetween.

2. The apparatus as set forth in claim 1 wherein the door means further comprises:

a vertically extending crankshaft mounted in an opening in the vent assembly for rotational movement;

a door secured to the crankshaft for covering the opening across the passageway; and a crank extending from the crankshaft, said crank acting as a lever arm for the application of a rotational force for effecting rotational displacement of the door.

3. The apparatus as set forth in claim 2 wherein the vent assembly further comprises said crankshaft having an extending pin at the end thereof distant from the crank and wherein the vent assembly further comprises an embossment defining an opening sized to cooperate with the pin for allowing rotational movement of the crankshaft.

4. The apparatus as set forth in claim 1 wherein the vent assembly further comprises an angled projection from a portion of the vent assembly which abuts against the partition, said projection being sized to extend through the opening to secure the vent assembly in the desired position relative to the partition.

5. The apparatus as set forth in claim 1 wherein the outdoor circulating means shroud and the outdoor circulating means act to divide the outdoor section into areas of relatively high pressure and relatively low pressure and wherein the vent assembly extends across the area of relatively low pressure to the outdoor circulating means shroud to receive air from the area of relatively high pressure.

6. The apparatus as set forth in claim 5 wherein the opening in the partition is positioned relative to the means for circulating air between the space to be conditioned and the indoor section such that said opening is located in an area of generally lower pressure from which said means for circulating air draws air and then directs said air which has been conducted through the passageway of the vent means to the space to be conditioned.

7. A vent assembly for installation in an air conditioning unit having an indoor section and an outdoor section, with a partition therebetween, the outdoor section having a fan shroud, and both the fan shroud and the partition having an opening formed therein for receiving the vent assembly which comprises:

a bottom portion including a bottom wall and sidewalls extending upwardly from the bottom portion said bottom wall including an embossment defining an opening;

a door assembly including a crankshaft having a downwardly extending pin which may be secured in the opening defined by the embossment for mounting the crankshaft thereto, a door connected to the crankshaft and a crank extending from the crankshaft for effecting rotational displacement of the crankshaft, said door assembly positioned between the indoor section and the outdoor section;

a top portion including a top wall and two downwardly extending sidewalls, said sidewalls mating with the sidewalls of the bottom portion such that the top and bottom portions together define an air flow passageway, said top portion defining an opening through which the crankshaft extends and the door of the door assembly being located between the top and bottom portions to control the flow of air through the passageway; and connection means for placing said vent assembly between and in interconnecting relationship with the openings in the partition and shroud, respectively.

8. The apparatus as set forth in claim 7 wherein at least one of the top portion or the bottom portion defines a door stop which acts to limit rotation of the crankshaft and the door and acts to provide a sealing surface preventing airflow through the passageway when the door is in the closed position.

9. The apparatus as set forth in claim 8 and further comprising spring means extending between the door and the bottom portion for biasing the door toward the closed position.

10. The apparatus as set forth in claim 9 wherein the top portion and the bottom portion define an abutment surface such that the vent assembly may be mounted to a planar member with the abutment surface contacting the member and the projections extending through the opening defined by the planar member to secure the vent assembly relative thereto.

11. The apparatus as set forth in claim 7 wherein the top portion and the bottom portion additionally each include means for securing a screen and a screen means mounted to the means for securing to extend across the passageway to prevent unwanted objects from flowing therethrough.

* * * * *